United States Patent [19]

Antonious

[11] Patent Number: 4,932,658

[45] Date of Patent: Jun. 12, 1990

[54] GOLF CLUB HEAD

[76] Inventor: Anthony J. Antonious, 205 E. Joppa Rd., Towson, Md. 21204

[21] Appl. No.: 345,223

[22] Filed: May 1, 1989

Related U.S. Application Data

[62] Division of Ser. No. 25,094, Mar. 12, 1987, Pat. No. 4,826,172.

[51] Int. Cl.[5] ..... A63B 53/04

[52] U.S. Cl. ..... 273/169; 273/167 H

[58] Field of Search ..... 273/167 R, 167 F, 167 H, 273/169, 170, 171, 172, 173, 174, 175, 167 D; D21/220

[56] References Cited

U.S. PATENT DOCUMENTS

| | | | |
|---|---|---|---|
| D. 244,703 | 6/1977 | Guzzle et al. | 273/167 D |
| 3,655,188 | 4/1972 | Solheim | 273/169 |
| 3,814,437 | 6/1974 | Winquist | 273/167 R |
| 3,847,399 | 11/1974 | Raymont | 273/169 |
| 4,826,172 | 5/1989 | Antonious | 273/169 |

*Primary Examiner*—George J. Marlo
*Attorney, Agent, or Firm*—N. J. Aquilino

[57] ABSTRACT

A perimeter weighted iron-type golf club head with a recessed or cavity back and a peripheral mass having an improved weight configuration formed of angularly disposed weight members within the cavity which are positioned adjacent to and above and below and on opposite sides of the center of gravity of the golf club head and located between the center of gravity and the peripheral mass of the golf club head.

3 Claims, 1 Drawing Sheet

GOLF CLUB HEAD

RELATED APPLICATION

The present application is a divisional of Ser. No. 07/025,094 filed Mar. 12, 1987, entitled Golf Club Head.

BACKGROUND OF THE INVENTION

1. Field of the Invention

The present invention relates to perimeter weighted golf club heads, and more particularly to recessed or cavity back iron type perimeter weighted golf club heads, having an improved weight distribution and configuration.

2. Description of the Prior Art

Over the years, iron type golf club heads have evolved from essentially flat blades to club heads adapted to improve the efficiency and control of the clubs by using numerous designs and weight configurations. Attempts at maximizing the weight characteristics of a golf club have included providing a solid back club, providing the majority of the weight on the back of a golf club head at the heel and at the toe portion of the club head, concentrating the weight at the bottom of the golf club head, concentrating the weight at both the bottom of the club head and the heel-toe areas, and locating the weight around the periphery of the golf club head. The latter attempt provides a deep recessed cavity in the back of the club head which is centrally located in the back of the club head.

Although the evolution of iron type golf club head designs has produced improvements over the original flat blades, the newer club head designs have limitations in distance, feel and control. For example, conventional iron-type heads with solid backs provide a solid feel but less distance and accuracy when miss-hit. Conventional cavity back clubs are more forgiving when the golfer miss-hits the ball, but they still sacrifice appreciable distance and accuracy when miss-hit. The other prior art iron-type club head designs have exhibited deficiencies in distance, feel and/or control.

SUMMARY OF THE INVENTION

The present invention overcomes the problems and disadvantages of the prior art by providing peripheral weighted iron type golf club heads and having a recessed or cavity back with additional weight members designed and positioned to provide increased control and feel, without sacrificing accuracy and distance.

An object of the present invention is to provide a peripheral weighted iron type golf club which permits a golfer to achieve improved control, feel, accuracy and distance.

Another object is to provide an iron type golf club head design that minimizes variances of the ball's flight when a ball is hit off-center, without sacrificing accuracy and distance of the ball's flight.

Still another object is to improve the playing performance of perimeter weighted golf club heads, particularly of the iron type, wherein a cavity in the back of the club head is defined by peripheral mass providing perimeter weighting of the club head by maximizing off-center hits of a golf ball, causing the ball to go farther and straighter when struck off the center of gravity (CG) of the club head.

In particular, an object of the present invention is to improve upon peripheral mass, perimeter weighting club head systems by having weight members between the club's center of gravity (CG) and the peripheral mass of the club head at points which are located adjacent to the center of gravity (CG) and are positioned at areas where golf balls are more frequently struck when the percussion center is missed. The additional weight members are optimally located and provide an increased stability and mass configuration causing miss-hit golf balls to travel farther and straighter and with a proper trajectory.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a weighting system for an iron-type golf club head including a hosel, a heel, a toe, an upper surface, a lower surface, a rear surface, a ball striking face, a complementary rear surface, and a center of gravity (CG), the weighting system comprising a peripheral mass formed on at least the heel, toe and lower surface portions of the outer periphery of the rear surface of the club head, the peripheral mass defining a cavity at the rear surface of the club head and providing a perimeter weighting for the club head, and at least two opposing weight members formed at the rear surface and within the rear cavity of the club head, the respective opposing weight members being located on opposite sides of the center of gravity (CG) and being positioned between the center of gravity (CG) and opposing sides of the peripheral mass.

In the specific embodiment of the present invention, the weight members are disposed adjacent to and on opposite sides and above and below the center of gravity (CG) in the area adjacent regions where most missed hits of a golf ball are made.

DESCRIPTION OF PREFERRED EMBODIMENTS

Figure 1:
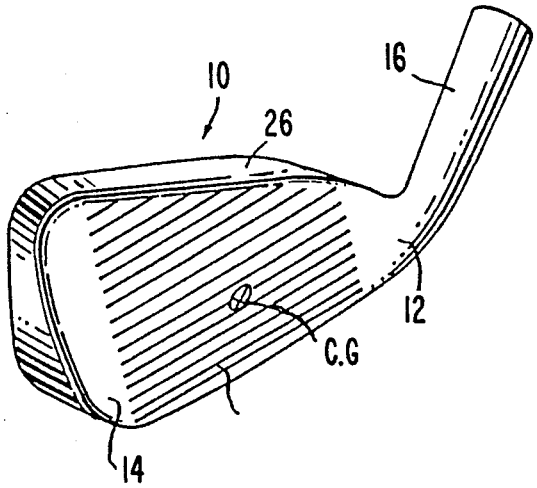
FIG. 1 is a front perspective view of a golf club head in accordance with the present invention.

Reference will now be made in detail to the present preferred embodiments of the invention, examples of which are illustrated in the accompanying drawings. Wherever possible, the same or like reference numerals will be used throughout the drawings to refer to the same or like parts.

Figure 2:
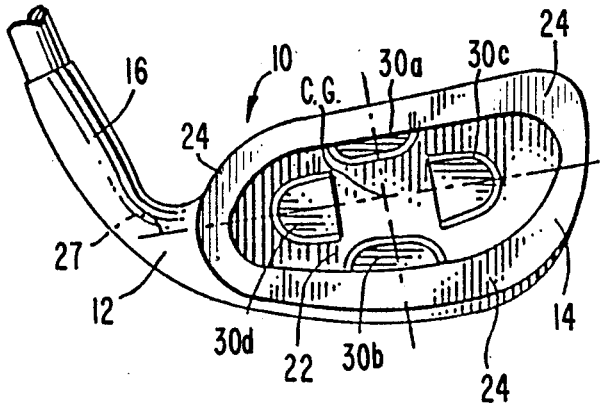
FIG. 2 is a rear elevational view of a golf club head of FIG. 1.
Figure 3:
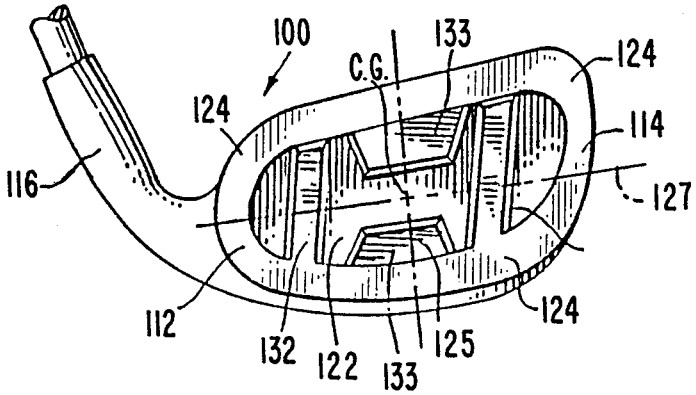
FIG. 3 is a rear elevational view of a second embodiment of the present invention.

FIGS. 1 to 3 illustrate one embodiment of a golf club head of the present invention. The club head 10 is an iron type including a heel 12, toe 14, hosel 16, and ball striking face 18, and a complementary rear surface 20. As illustrated in the drawings, the club head 10 has a center of gravity (CG) shown on the ball striking face 18, and also on the rear surface 20 of the club head 10. Preferably the center of gravity (CG) is located at approximately the center of the club head and at the center of percussion where a ball is struck to provide maximum distance and control. The club head 10 includes a rear cavity 22 which is defined by a peripheral mass 24 which concentrates the weight of the club head around the outer edge of the golf club head as illustrated in FIG. 2.

Weight members 30*a* and 30*b* and 32*a* and 32*b* are disposed about the center of gravity (CG) of the club head 10. Weight members 30*a* and 30*b* are located above and below the center of gravity (CG) and fall on a line which is perpendicular to the longitudinal axis 27 of the golf club head 10 and extending through the center of gravity (CG). Weight members 30*c* and 30*d* are located between the center of gravity (CG) and the toe and heel repectively and fall on the line which extends along the longitudinal axis 27 of the club head 10 and through the center of gravity (CG). The weight members are fixed to the rear face, and can be positioned and sized either adjacent to or spaced from the peripheral mass 24 of the club head 10 to provide optimum weight distribution.

FIG. 3 illustrates a second embodiment of a golf club head 100 of the present invention including a heel 112, toe 114, and hosel 116. This embodiment includes a cavity 122 and a peripheral mass 124 disposed around the cavity 122. The club head 100 includes vertical weight members 130 and 132 on either side of the center of gravity (CG) and which are similar to those illustrated and described in parent application Ser. No. 025,094, now U.S. Pat. No. 4,826,172. Additional weights 133 and 133*a* are located above and below and adjacent to the center of gravity (CG) and between the weight members 130 and 132. Weight members 133 and 133*a* lie on a line 125 extending through the center of gravity (CG) and perpendicular to the longitudinal axis 127 of the golf club head 100. The addition of these weights adds to the feel of the club, and the weights can be sized to promote accuracy and distance.

It will be appreciated that the angularly disposed weight members can be used to accommodate the optimum playing characteristics of a particular golfer's swing by varying the size and location of the shaped weights within the cavity. Other various changes such as the shape of the weight members can be made in keeping within the spirit and scope of the present invention as defined in the following claims.

I claim:

1. An iron type golf club head having an improved weighting system, said club head having a hosel, a heel, a toe, a bottom surface, an upper surface, a rear surface, a ball striking face, and a center of gravity;

a peripheral mass formed on said rear surface adjacent at least said heel, toe and bottom surface of said club head, said peripheral mass defining a cavity formed within said peripheral mass;

said weighting system including a plurality of opposing weight members formed on said rear surface and within said cavity of the club head and the respective opposing weight members surrounding the center of gravity, said cavity being devoid of any weight member formed on said rear surface at the location of said center of gravity, at least one weight member being located between and spaced from the center of gravity and the toe;

a second opposing weight member being located between and spaced from the center of gravity and the heel;

a third weight member being located above the center of gravity;

a fourth weight member being located below the center of gravity and all of said weight members being located a substantial distance away from said center of gravity so that no portion of any of said weight members is located at said center of gravity.

2. The iron type club head of claim 1 wherein said first and second weight members intersect the longitudinal axis of the said club head.

3. The iron type club head of claim 2 wherein said third and fourth weight members intersect a line perpendicular to said longitudinal axis of said club head.

* * * * *